US006474559B2

(12) United States Patent
Park

(10) Patent No.: US 6,474,559 B2
(45) Date of Patent: Nov. 5, 2002

(54) ROOM GRATING CONTROL

(76) Inventor: Chan-Woo Park, 297 Worth Blvd., Thornhill, Ontario (CA), L4J 7V9

( * ) Notice: Subject to any disclaimer, the term of this patent is extended or adjusted under 35 U.S.C. 154(b) by 0 days.

(21) Appl. No.: 09/985,992

(22) Filed: Nov. 7, 2001

(65) Prior Publication Data

US 2002/0058473 A1 May 16, 2002

Related U.S. Application Data

(63) Continuation of application No. 09/660,353, filed on Sep. 12, 2000, now Pat. No. 6,340,329.

(30) Foreign Application Priority Data

Jan. 13, 2000 (CA) ..... 2295891

(51) Int. Cl.[7] ..... F24F 7/00
(52) U.S. Cl. ..... 236/49.3
(58) Field of Search ..... 236/49.3; 454/256, 454/258, 290, 298, 324, 334; 137/601.12, 601.14, 601.15, 601.18; 251/77

(56) References Cited

U.S. PATENT DOCUMENTS 1,778,560 A * 10/1930 Marsh et al. ..... 236/49.3
2,143,351 A * 1/1939 Kingsland et al. ..... 165/250
2,154,523 A * 4/1939 Midyette, Jr. ..... 236/38
2,456,489 A * 12/1948 Burkholder, Jr. ..... 236/49.3
2,479,243 A * 8/1949 Larsen ..... 236/49.3
2,534,174 A * 12/1950 Lehane et al. ..... 236/49.3
2,537,315 A * 1/1951 Newton ..... 236/1 C
2,584,691 A * 2/1952 Galeaze ..... 236/49.3
2,750,868 A * 6/1956 Mieczkowski et al. .... 236/49.3
3,420,439 A * 1/1969 Meckler ..... 165/53
4,258,877 A * 3/1981 White ..... 236/49.3
4,401,260 A * 8/1983 Grant ..... 236/9 A
4,407,187 A * 10/1983 Horney ..... 454/324
4,666,477 A * 5/1987 Lough ..... 137/625.3
4,834,283 A * 5/1989 Akabane et al. ..... 236/13
5,833,134 A * 11/1998 Ho et al. ..... 236/49.3
6,052,999 A * 4/2000 Park et al. ..... 165/288

FOREIGN PATENT DOCUMENTS

CA 1188915 * 7/1985
CA 1195167 * 10/1985

* cited by examiner

*Primary Examiner*—Harold Joyce
(74) *Attorney, Agent, or Firm*—R. L. Westell

(57) ABSTRACT

An air grating where the air flow is controlled by a grid movable between OPEN and CLOSED positions. Control means acts when a thermostat switch closes at either a warm or a cool limiting position. The arrival at a limiting position prepares said moving means for movement to the other limiting position when a later thermostat signal is received.

4 Claims, 8 Drawing Sheets

ROOM GRATING CONTROL

This application is a Continuation of Application Ser. No. 09/660,353 U.S. Pat. No. 6,340,329 filed Sep. 12, 2000.

This invention relates to gratings to allow or impede flow of hearing or air conditioning into a room.

In a first aspect the gratings with which the invention comprise a stationary and a slidable grid. The slidable grid is adapted to move between a limit position allowing a substantial air passage, and known as the OPEN position and a position blocking substantial air passage known as the CLOSED position. Control will customarily be by thermostat as hereafter described.

In a second aspect, a surface grating which faces upwardly is shaped to define a recessed shape to receive an upper or third grating. The upper grating will sit on a filter held by the recessed shape for application use and replacement, the recessed arrangement described is found to provide best filter use so far encountered.

With this recessed arrangement shown, the filter is held in place by the upper grating which may be removed to change, insert or remove a filter. This is the most efficient filter arrangement yet devised.

The first aspect of relatively movable grids may be and the second aspect of recessing the upper shape of the grating may of course be present in the same device or may be singly present in different devices.

The slidable grid will preferably be constructed so that there are no positions between OPEN and CLOSED limiting position so that the grid merely moves between these limiting positions. Preferably a motor is connected to drive the movable grid between limiting positions. The motor is controlled by a thermostat.

The preferred principle of operation is that the movable grid may be called for to move to an OPEN position as ( in the winter ) the thermostat calls for a warmer temperature and CLOSE when the thermostat calls for cooler temperature. (In the summer the OPEN and CLOSED positions correspond to respective desires for cooler and warmer temperatures.) It is found easier herein to describe the winter thermostat and to refer briefly to the opposite summer settings. Accordingly, in the winter if the movable grating is closed the circuitry for the motor is arranged so that the contact is closed which will turn the motor to move to open grating position when the thermostat calls for warmer temperatures. Thus when the grating reaches open position the associated controls close the contacts ready to move the grating back to closed as soon as the thermostat calls for cooler temperatures. In a preferred form of the invention the end of a movement to open or closed position cuts all power to the drive circuit avoiding motor loss and extra safety controls.

Since in the preferred arrangement, the movable grid moves between limiting positions and requires no power at the limiting positions, there is a great saving with the inventive arrangement since the power and the control circuit are disconnected from the power after each change of limiting positions.

There are a great many ways that the movable grid may be thus controlled and these are all considered within the scope of the invention.

The use of one or more thermostatically controlled gratings is believed to create great fuel savings in heating costs (or in summer, cooling) costs. For a number of gratings in one room may be run to be controlled movable to be powered in parallel under the control of a single thermostat. It is found that the thermostat control may carry enough current that four or five motors for movable grating control may be powered by the current carried by a single thermostat.

I prefer to achieve the drive by a motor rotatable in one direction and driving a cam which over one 180° rotation will contact a stop for the movable grid for OPEN to CLOSED position.

A resilient yieldable aim is preferably provided whereby if there is resistance to the movable grid movement, such movement will merely stress the aim and the movement will not be completed until the cause of the resistance is removed. This provides a useful safety feature since for example fingers stuck in a closing grating will not be crushed In a preferred form of the invention the motor drives the movable grid between OPEN and CLOSED positions whether in a 180° half cycle as previously discussed or otherwise, and then is adapted to operate a cam to shut off the motor power at each limiting position. The cam connects a switch in the motor control circuit so that the motor is ready to drive the movable grating in the other direction, but does not because the thermostat is not then calling for the movement, leaving that part of the circuit open.

In a preferred form of the invention the motor for driving the movable grid is connectable for rotation through one of two alternate circuits. One of the alternate circuits is adapted to power the motor during travel from CLOSED to OPEN position and the other to power the motor during travel from OPEN to CLOSED positions. A cam operable by the motor controls an arm setting operable on arrival at CLOSED position to set the arm to break power in the closing circuit (thus cutting all power to the motor) and at the same time setting the cam to connect the motor to be ready to power the opening circuit when later called for by the thermostat.

Thus there are two circuits for the motor. The normally closed circuit contacts are preferably connected in series with the warm limit contact of the thermostat and the normally open circuit is preferably connected in series with the cool limit contact.

Thus in the winter with the grating full OPEN for maximum air flow, the motor cam is positioned to complete the circuit to close the grid when there is a call for a cooler temperature.

Thus when the thermostat temperature is at the warm limit caused it completes the motor circuit to close the grating.

In drawings showing a preferred embodiment of the invention:

Figure 1:
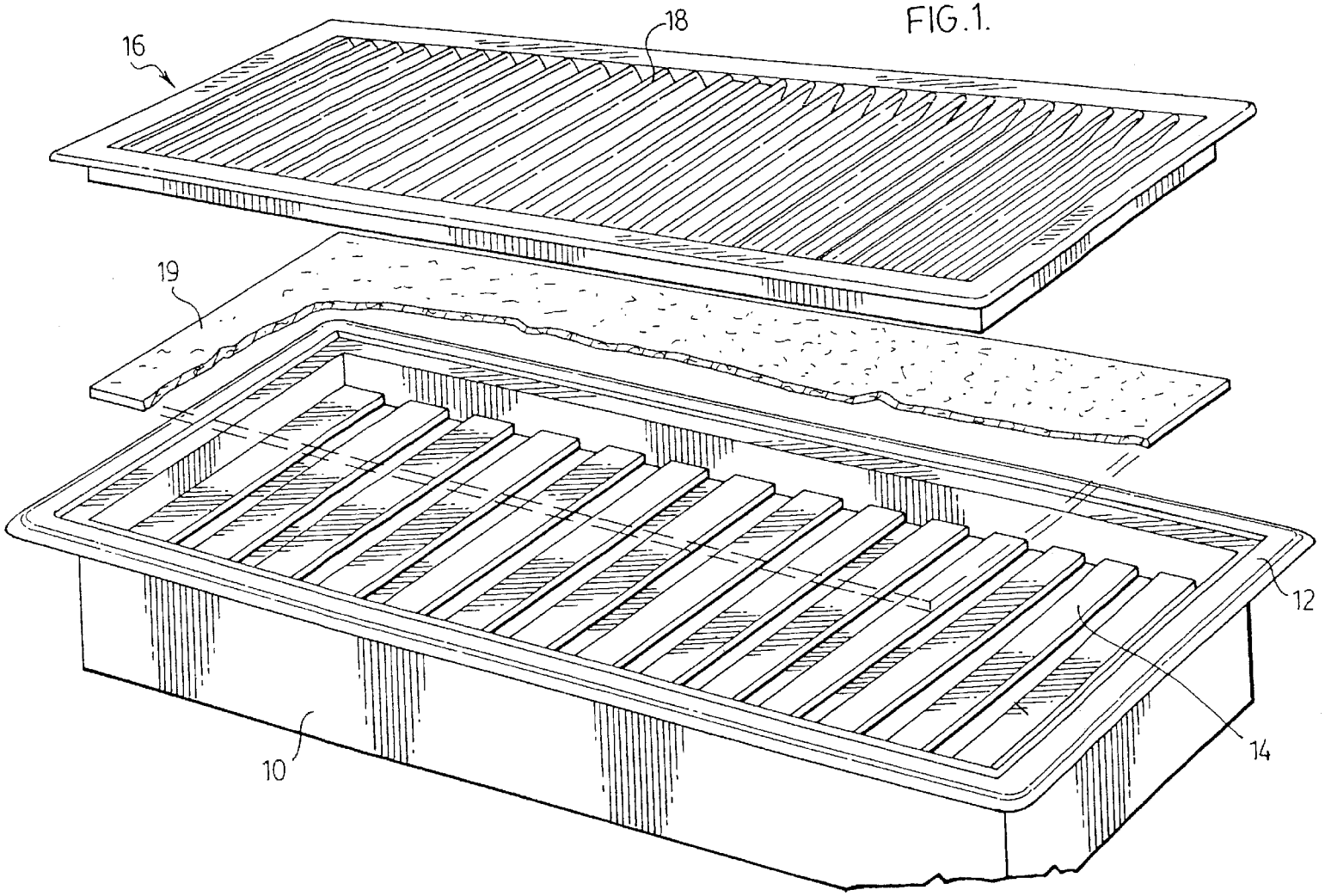
FIG. 1 shows the stationary grid recessed to receive an upper grid which may retain a filter in between grids.

In FIG. 1 a fixed grid is shown having side walls 10, upper ledge 12, grating bars 14. It will be noted that the ledge 12 and grating bars 14 form with side wall 10 a recess for the upper grid 16, which is shaped to rest in the recess preferably having bars 18 and shaped to retain between the upper grid and the fixed grid, air filter material 17. The upper grid 16 may be replaced by a peripheral rim without cross bars although this is not preferred.

Figure 8:
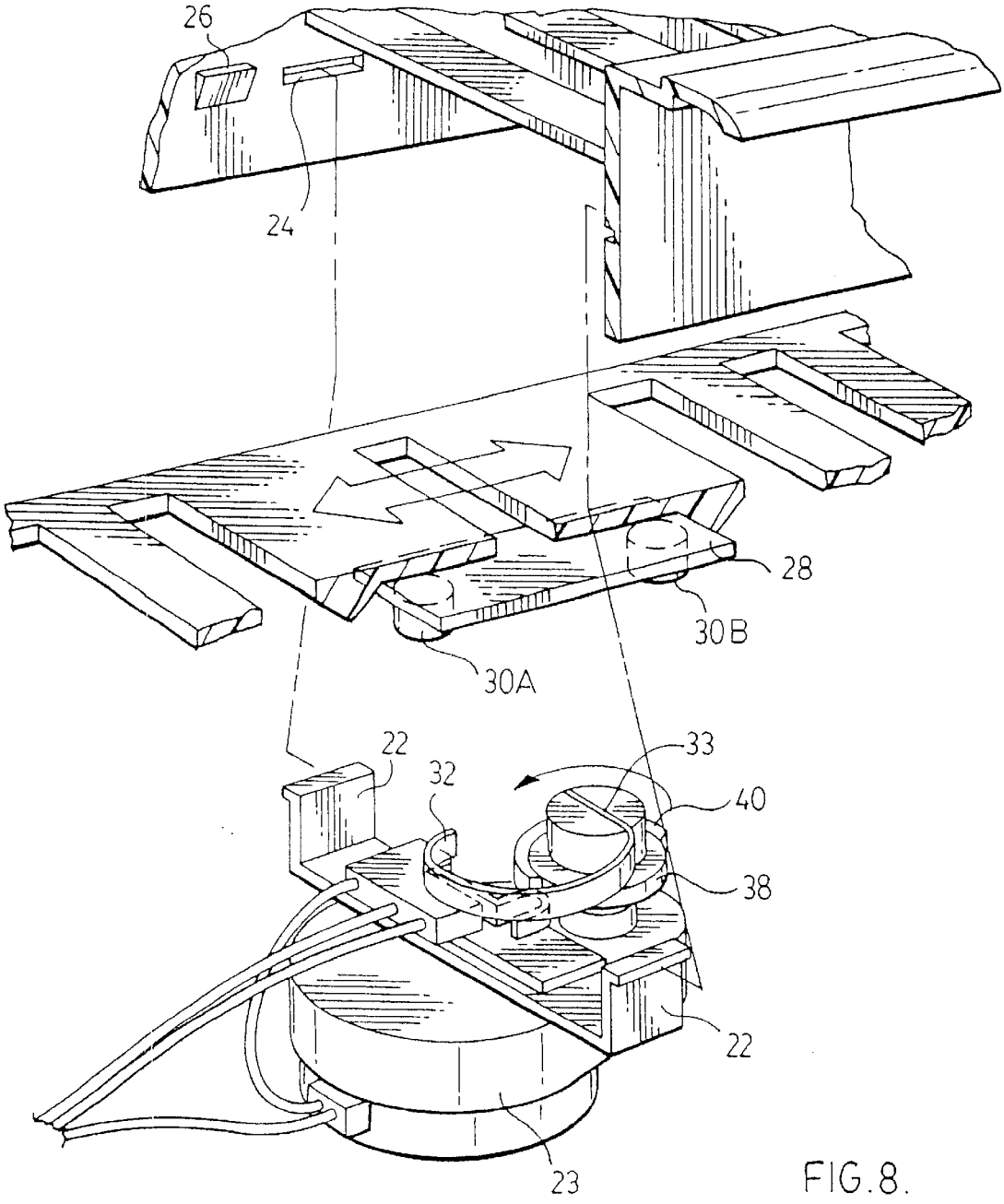
FIG. 8 is an exploded perspective view showing the relationship of the fixed grid, movable grid drive arm, control cam and motor.

FIG. 8 shows the drive motor 23 mounted on frame 20 which has spring clips 22 which rest in slots 24 in fixed grid walls 10 to support the motor. The movable grid 31 rides on surfaces (most, not shown) 26 on the side walls 10. A plate 28 on the lower side of the movable grid has two downward projections 30A and 30B so the movable grid 31 may be moved between OPEN and CLOSED positions by a resilient spring 33 drive arm 32 which spirals outward from a center (driven by the motor) to contact one downward projection 30A when the movable grid 31 is moving toward OPEN position (see also FIG. 2 and FIG. 4) and to contact the other downward projection 30B when the movable grid is moved toward CLOSED position (see also FIG. 3 and FIG. 5).

Figure 4:
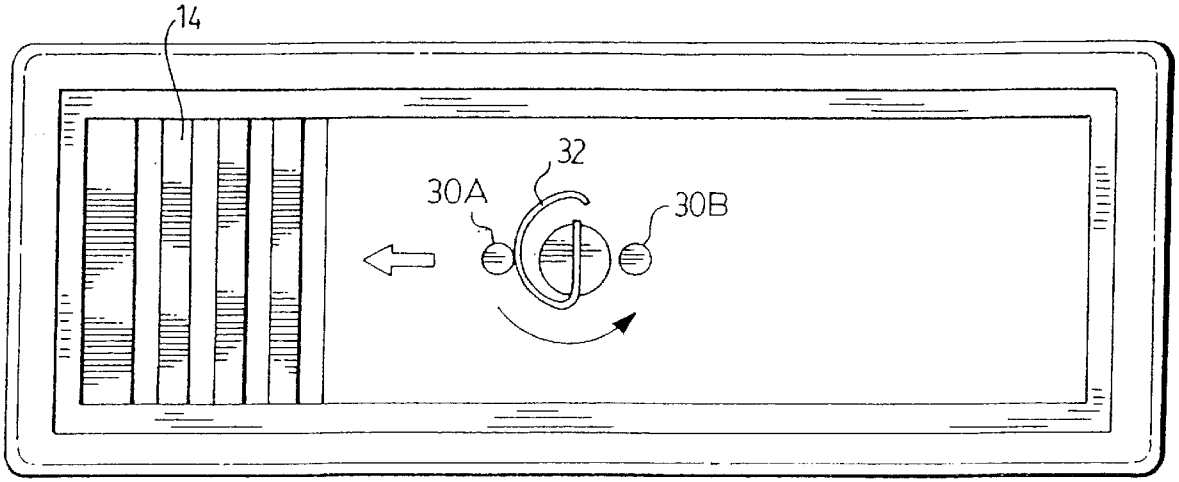
FIG. 4 shows a schematic view of the fixed and movable grid members (with the upper grid removed adjacent the drive for clarity) with the movable grid in OPEN position, and showing the operation of the drive arm.
Figure 5:
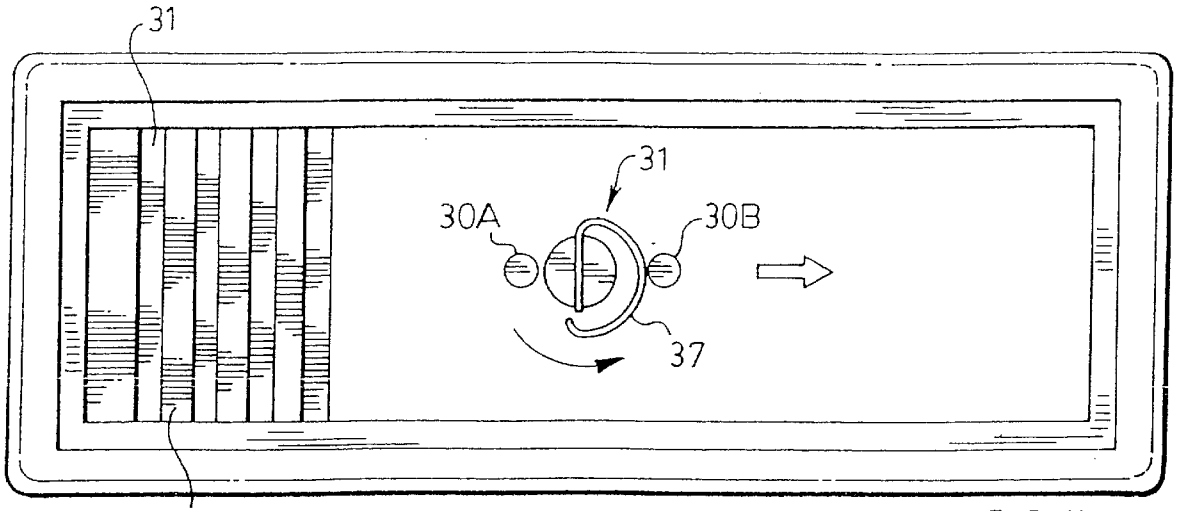
FIG. 5 is a plan view of the same components as those of FIG. 4 with the movable grid in closed position.

Thus FIGS. 4 and 5 show in vertical view movable grating in OPEN and CLOSED position, respectively. Mounted on the same rotary member as the yieldable spring 32 is driven cam 36 having inner cam surface 38 and outer cam surface 40 to control the arm 42 or relay 44.

Figure 6:
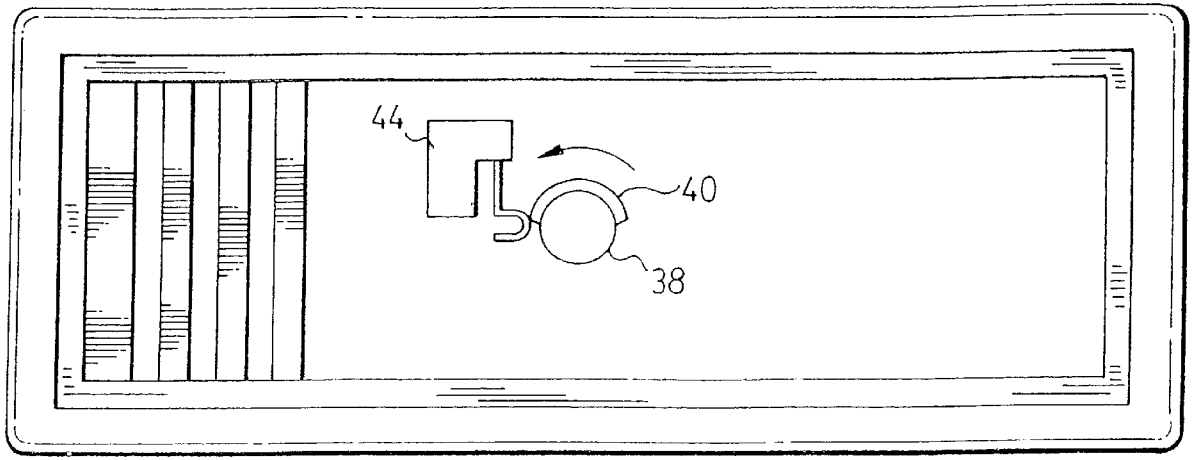
FIG. 6 shows a schematic view looking downward of the fixed and movable grid members (with the upper grid removed for clarity) with the movable grid in OPEN position and showing the operation of the control cam.
Figure 7:
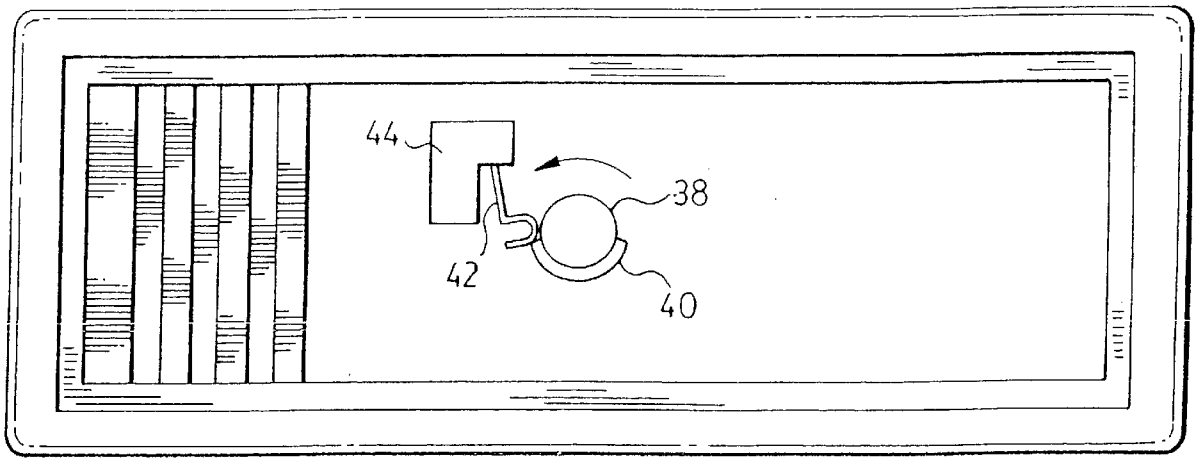
FIG. 7 is a downward view of the same components as those of FIG. 6 with the movable grid in CLOSED position.

For clarity the cam and relay are omitted in FIGS. 4 and 5 and the spring arm 32 is omitted in FIGS. 6 and 7.

Figure 9:
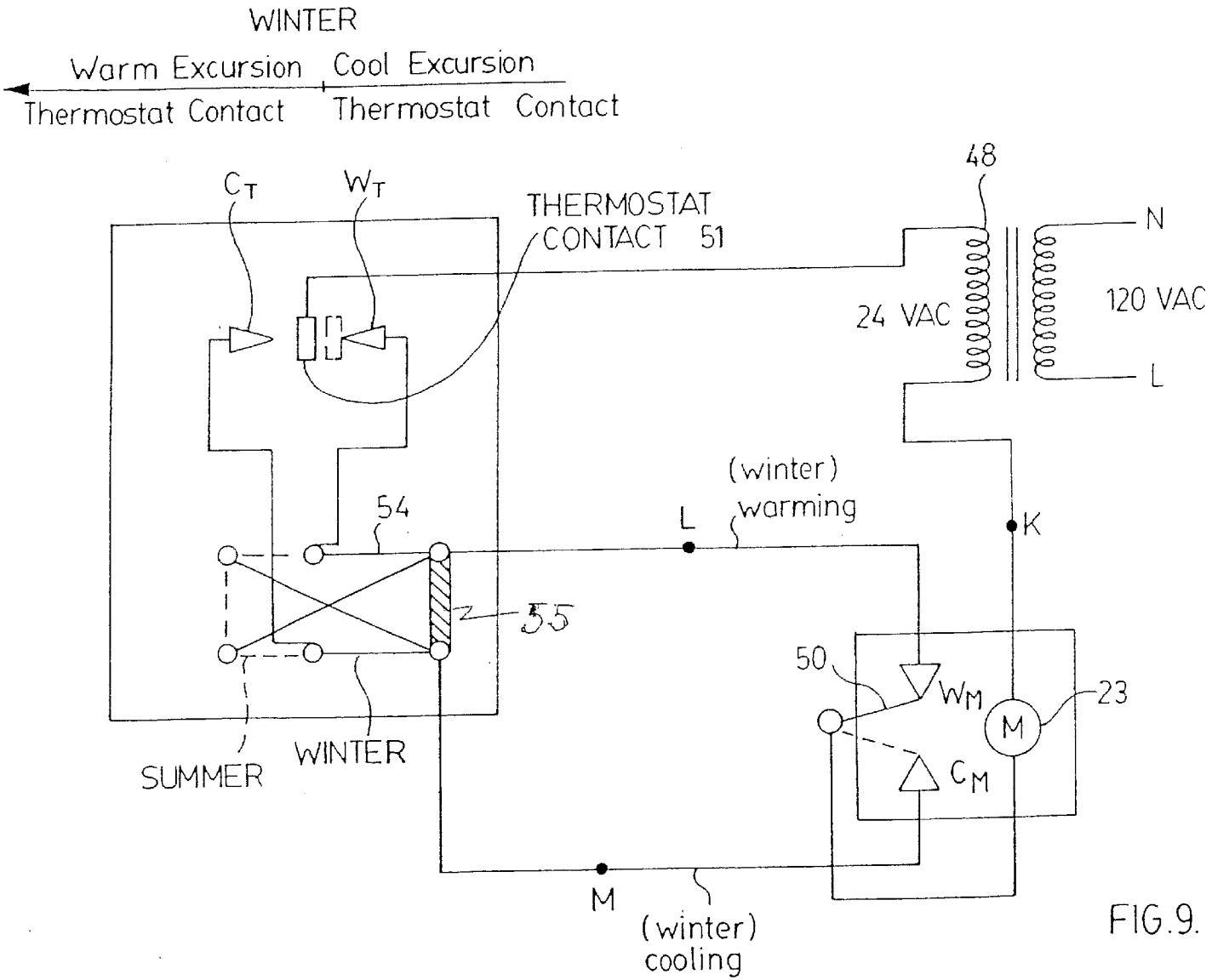
FIG. 9 is a schematic representation of the control circuit.

The operation of the control circuit is shown in FIG. 9. As shown in FIG. 9 the power of the motor 23 drive is usually obtained from the 24V output 48 of a transformer to power the circuit extent running from the movable temperature sensing contact 51 of the thermostat (which has lower temperature limit and upper temperature limit contacts CT and WT), through motor 23 to power it to move arm 50 which connects to one of two circuits.

Figure 10A:
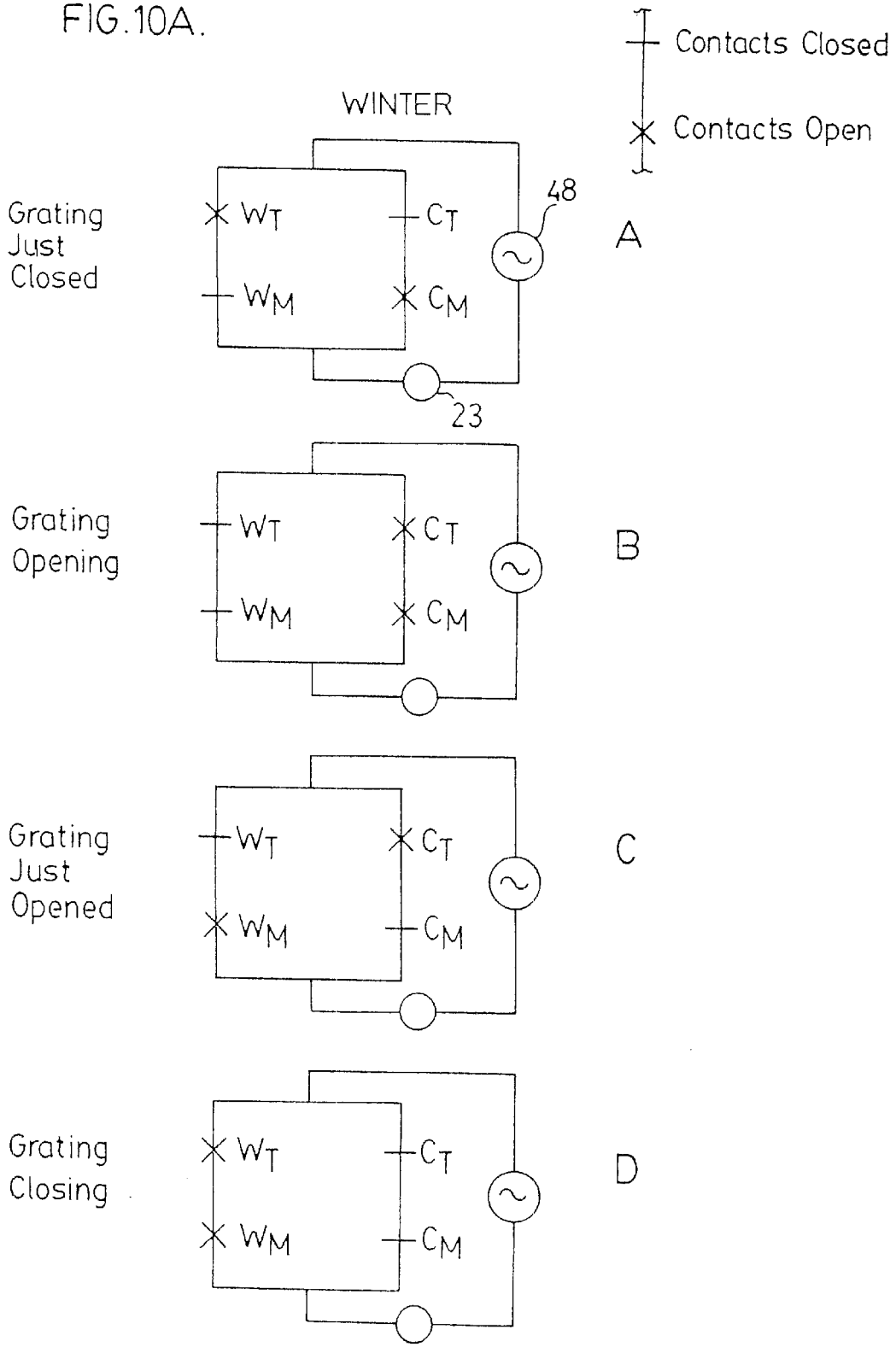
FIGS. 10A and 10B are schematic circuit representations of the operating cycle contact positions in winter and summer respectively.

Arm 50 is driven by relay arm 42. Thus arm 42 is set so when on cam surface 40 it causes arm 50 to connect to motor contact CM. When arm 42 has a. position on cam surface 38, it causes arm 50 to connect to motor contact WM. Thus in relation to FIG. 6 the cam has just completed its travel to move the grid to open position and moved off cam 38 to cam 40 to move arm 50 from WM to CM (see also FIGS. 10A–C for final position). In relation to FIG. 7 the cam has just completed its travel to move the grid to closed position from surface 40 onto surface 38 to move arm 50 from contact CM to contact WM (see also FIGS. 10A–D and 10B–D for final position).

The two circuits with the double pole double throw switch (DPDT) 54' in winter position provides one circuit WM to WT to drive the motor for warming (opening the grating) and the other circuit CM to CT for cooling (closing the grates). (With switch 54 in summer position the DPDT switch will be in summer position so that warming corresponds to closing the grating and cooling corresponds to opening). 55 is a non-conducting portion of the selector switch.

Figure 3:
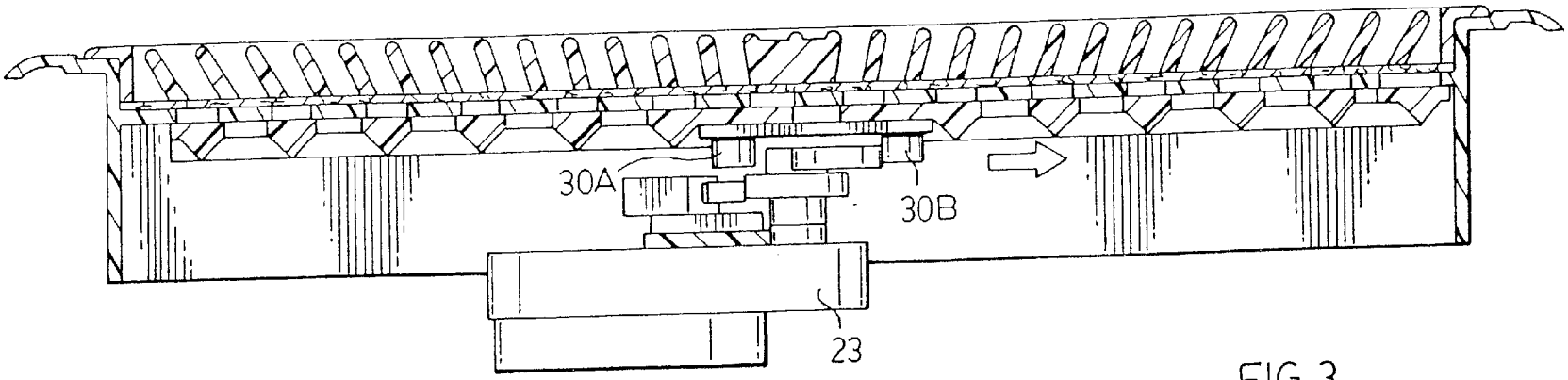
FIG. 3 shows to same members as FIG. 2 with the movable grid in closed positions.

In operation with the winter setting on and the grating closed as in FIG. 3 the thermostat moving contact 51 is between the warm limiting excursion CT and cool limiting excursion WT (FIG. 9).

Cam surface 38 allows relay contacts WM to close but WT is open when thermostat contact 51 is between contacts WT and CT.

Figure 2:
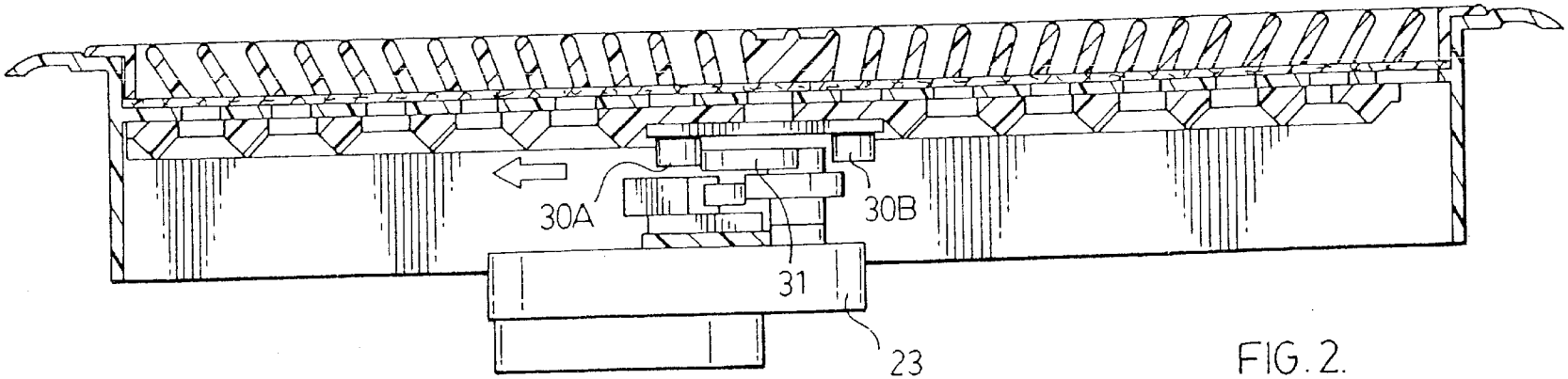
FIG. 2 shows the upper grid, stationary grid and movable grid in vertical section with the movable grid in OPEN positions.

When the air has cooled so that thermostat contact 51 contacts WT, the motor circuit is completed over contacts WT and WM (see also FIGS. 10A–B) aid the motor operates the spring arm to the position of FIGS. 2 and 4 so that the grating is OPEN. At the same time, at the open position cam surface 40 moves aim 42 to open switch WM cutting off all power to the motor (see FIG. 6 and FIGS. 10A–C) but closing CM ready for the next closing cycle. (The contacts WT in FIG. 10C will be later open when the thermostat terminal moves away from WT).

This state of affairs will continue until the thermostat calls for cooling by having its contact 51 contact CT. This closes the contacts CM, CT in series to cause the motor to operate the movable grate from the position of FIG. 2, FIG. 4 to that of FIG. 3, FIG. 5. Reference may also be had to FIGS. 10A–D. When the grating reaches its closed limiting position (FIG. 7) the cam moves the relay arm from surface 40 to surface 38 opening switch CM, cutting off all power to the motor and closing switch WM ready for the next call for a warming cycle. (See FIGS. 10A—A).

Figure 10B:
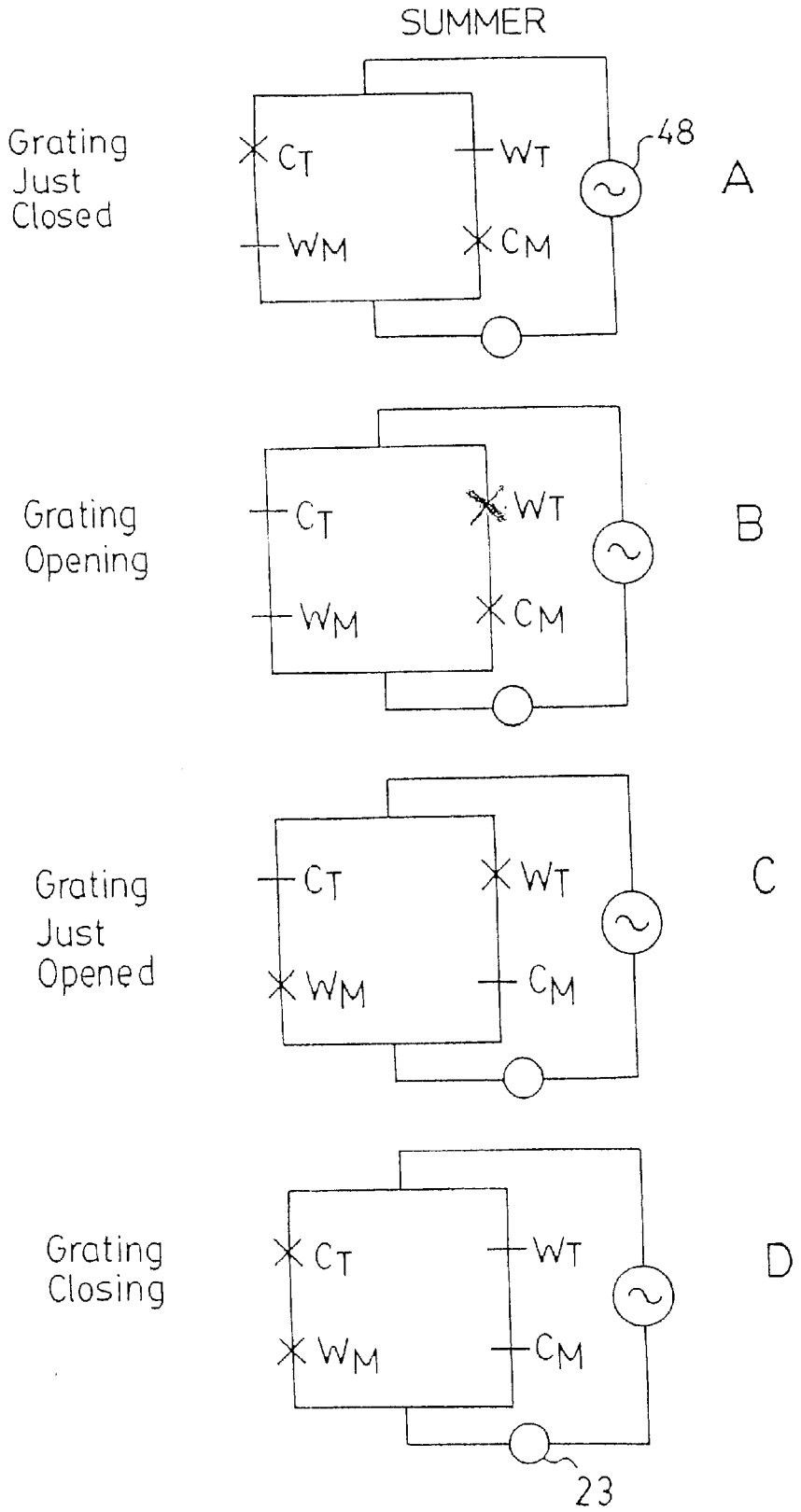

In the summer the DPDT switch is moved to the dotted line position. An OPEN grating is the response to a call for cooling and closed to a call for warming, thus the alternative circuits (see also FIG. 10B) for the motor are CT and WM in series for opening the grating FIGS. 10B—B) and WT and CM in series for closing the grating (FIGS. 10B–D).

The driving of the movable grid between open and closed positions by a yieldable aim avoids injury since if, for example a finger or object is stuck into the grating while closing the yieldable aim will allow the grating to stop without injury even though the motor is attempting to close the grate.

The recessed grates for the filter allow easy application, inspection and removal of the filter.

With reference to the circuitry shown in FIG. 9, it is found that current over the thermostat contacts 51-WT or 51-CT may each have the strength of one ampere with the present commercially available thermostats. At the same time, motors to serve the function of the motor 23 are readily available which will operate at 150 milliamp. Thus it can be seen as easy to operate a number of gratings (e.g. up to 5 or 6) by a single thermostat with the motors connected parallel at connections K, L, M of FIG. 9. The parallel controlled motors would presumably be located in a single room or environment.

In a preferred embodiment of the invention, a motor 23 is used having a metallic outer casing for damage, corrosion and fire protection.

I claim:

1. A room air grating, wherein air flow is controlled by a grid movable by an electric motor between OPEN and CLOSED limiting positions, a motor switch operable between first and second positions, said motor connected with said motor switch in a first position and responsive the closing of a first thermostat switch to receive power to drive said grid from a first to a second position, said motor operating a cam at said second position to change said motor switch to switch to second position and cut off power to said motor, said motor connected with said motor switch in second position and responsive the closing of a second thermostat switch to receive power to drive said grid from said second to said first position, said motor operating said cam at said first position to first to cut off power to said motor.

2. A room air grating as claimed in claim 1 including a reversing switch operable to reverse the drive direction relative to the selection of the thermostatic switch closure to initiated the drive.

3. Room air grating as claimed in claim 1, Wherein said motor rotates approximately 180° to move said movable grid between positions and rotates in the same direction for moving from first to second as second to first position.

4. Room air grating comprising:

a first grid, a second grid movable between OPEN and CLOSED positions relative to said first grid, a thermostat having upper and lower temperature limit switches, a motor responsive to closure of one of said temperature limit switches for moving said second grid to one of said positions to respectively reduce or increase said temperature, and to then disconnect power from said motor, said motor responsive to closure of the other of said limit switches to move said second grid to the other of said position, and to then disconnect power from said motor, wherein said motor operates a rotatable member to move said second grid, and also operates a cam operable between OPEN and CLOSED positions to maintain said motor operation until a limiting position is reached, said cam being operable at said limiting position to prepare for energization of said motor for movement in the opposite direction when said other thermostat switch is closed.

* * * * *